US007062438B2

(12) United States Patent
Kobayashi et al.

(10) Patent No.: US 7,062,438 B2
(45) Date of Patent: Jun. 13, 2006

(54) SPEECH SYNTHESIS METHOD AND APPARATUS, PROGRAM, RECORDING MEDIUM AND ROBOT APPARATUS

(75) Inventors: Kenichiro Kobayashi, Kanagawa (JP); Nobuhide Yamazaki, Kanagawa (JP); Makoto Akabane, Tokyo (JP)

(73) Assignee: Sony Corporation, Tokyo (JP)

( * ) Notice: Subject to any disclaimer, the term of this patent is extended or adjusted under 35 U.S.C. 154(b) by 302 days.

(21) Appl. No.: 10/388,107

(22) Filed: Mar. 13, 2003

(65) Prior Publication Data

US 2004/0019485 A1 Jan. 29, 2004

(30) Foreign Application Priority Data

Mar. 15, 2002 (JP) ..... 2002-073385

(51) Int. Cl.
*G10L 13/08* (2006.01)

(52) U.S. Cl. ..... 704/260; 704/270; 704/258

(58) Field of Classification Search ..... 704/270, 704/260, 258, 267, 205; 84/609–610
See application file for complete search history.

(56) References Cited

U.S. PATENT DOCUMENTS 5,642,470 A * 6/1997 Yamamoto et al. ..... 704/270
5,890,117 A * 3/1999 Silverman ..... 704/260
6,226,614 B1 * 5/2001 Mizuno et al. ..... 704/260
6,304,846 B1 * 10/2001 George et al. ..... 704/270
6,424,944 B1 * 7/2002 Hikawa ..... 704/260
6,446,040 B1 * 9/2002 Socher et al. ..... 704/260
6,810,378 B1 * 10/2004 Kochanski et al. ..... 704/258
6,823,309 B1 * 11/2004 Kato et al. ..... 704/267

OTHER PUBLICATIONS

Macon, M.W.; Jensen-Link, L.; Oliverio, J.; Clements, M.A.; George, E.B. "A singing voice synthesis system based on sinusoidal modeling" Acoustics, Speech, and Signal Processing, 1997. ICASSP-97., 1997 IEEE, International Conference on, vol.: 1 , 21-24.*

(Continued)

*Primary Examiner*—Wayne Young
*Assistant Examiner*—Huyen X. Vo
(74) *Attorney, Agent, or Firm*—Frommer Lawrence & Haug LLP; William S. Frommer; Thomas F. Presson

(57) ABSTRACT

A sentence or a singing is to be synthesized with a natural speech close to the human voice. To this end, singing metrical data are formed in a tag processing unit 211 in a singing synthesis unit 212 in a speech synthesis apparatus 200 based on singing data and an analyzed text portion. A language analysis unit 213 performs language processing on text portions other than the singing data. As for a text portion registered in a natural metrical dictionary, as determined by this language processing, corresponding natural metrical data is selected and its parameters are adjusted in a metrical data adjustment unit 222 based on phonemic segment data of a phonemic segment storage unit 223 in the metrical data adjustment unit 222. As for a text portion not registered in the natural metrical dictionary, a phonemic symbol string is generated in a natural metrical dictionary storage unit 214, after which metrical data are generated in a metrical generating unit 221. A waveform generating unit 224 concatenates necessary phonemic segment data, based on the natural metrical data, metrical data and the singing metrical data to generate speech waveform data.

24 Claims, 12 Drawing Sheets

OTHER PUBLICATIONS

Patent Abstracts of Japan, publication No. 09-244869 dated Sep. 19, 1997.
Patent Abstracts of Japan, publication No. 11-184490 dated Jul. 9, 1999.
Patent Abstracts of Japan, publication No. 02-027397 dated Jan. 30, 1990.
Patent Abstracts of Japan, publication No. 07-146695 dated Jun. 6, 1995.

* cited by examiner

| INDICATION | PARAMETERS | [LABEL] | [PITCH] | [VOLUME] |
|---|---|---|---|---|
| SAY | – | • • • | • • • | • • • |
| SAY | CALMNESS | • • • | • • • | • • • |
| SAY | ANGER | • • • | • • • | • • • |
| SAY | SADNESS | • • • | • • • | • • • |
| SAY | HAPPINESS | • • • | • • • | • • • |
| SAY | COMFORT | • • • | • • • | • • • |
| ⋮ | ⋮ | ⋮ | ⋮ | ⋮ |

FIG.3

| | INPUT EVENT NAME | DATA NAME | DATA RANGE | PROBABILITY OF TRANSITION TO OTHER NODE | | | | | |
|---|---|---|---|---|---|---|---|---|---|
| node 100 | | | | A | B | C | D | | n |
| TRANSITION DESTINATION NODE | | | | node 120 | node 120 | node 1000 | | | node 600 |
| OUTPUT BEHAVIOR | | | | ACTION 1 | ACTION 2 | MOVE BACK | | | ACTION 4 |
| 1 | BALL | SIZE | 0.1000 | 30% | | | | | |
| 2 | PAT | | | | 40% | | | | |
| 3 | HIT | | | | 20% | | | | |
| 4 | MOTION | | | | | 50% | | | |
| 5 | OBSTACLE | DISTANCE | 0.100 | | | 100% | | | |
| 6 | | JOY | 50.100 | | | | | | |
| 7 | | SURPRISE | 50.100 | | | | | | |
| 8 | | SADNESS | 50.100 | | | | | | |
| | | | | | | | | | |

90

FIG. 12

SPEECH SYNTHESIS METHOD AND APPARATUS, PROGRAM, RECORDING MEDIUM AND ROBOT APPARATUS

BACKGROUND OF THE INVENTION

1. Field of the Invention

This invention relates to a speech synthesis method, a speech synthesis apparatus, a program, and a recording medium for synthesizing the sentence or the singing by a natural speech or voice close to the human voice, and a robot apparatus outputting the speech.

This application claims priority of Japanese Patent Application No.2002-073385, filed on Mar. 15, 2002, the entirety of which is incorporated by reference herein.

2. Description of Related Art

A mechanical apparatus for performing movements simulating the movement of the human being (or animate beings), using electrical or magnetic operation, is termed a "robot". The robots started to be used widely in this country towards the end of 1960s. Most of the robots used were industrial robots, such as manipulators or transporting robots, aimed at automation or unmanned operations in plants.

Recently, development in practically useful robots, supporting the human life as a partner, that is supporting the human activities in various aspects of our everyday life, such as in living environment, is progressing. In distinction from the industrial robots, these practically useful robots are endowed with the ability to learn for themselves the method for adaptation to human being with variable personalities, or to variable environments, in the variegated aspects of our everyday life. For example, pet-type robots, simulating the bodily mechanism or movements of animals, such as quadruples, e.g., dogs or cats, or so-called humanoid robots, simulating the bodily mechanism or movements of animals erected and walking on feet, such as human being, are already being put to practical use.

As compared to the industrial robots, the above-described robot apparatus are able to perform variable entertainment-oriented operations, and hence are sometimes called entertainment robots. Among these robot apparatus, there are those operating autonomously responsive to the external information or to the inner states of the robot apparatus.

The artificial intelligence (AI), used in these autonomously operating robot apparatus, represents artificial realization of intellectual functions, such as inference or decision. It is also attempted to realize the functions of feeling or instinct by artificial means. The means for representing the artificial intelligence to outside may be realized by means for visual or auditory representation. As typical of such means for the auditory representation is speech.

Meanwhile, the synthesis system for the speech synthesis apparatus, applied to such robot apparatus, may be exemplified by a text speech synthesis system. In the conventional speech synthesis from the text, the parameters necessary for speech synthesis are automatically set responsive to the results of the textual analysis, so that, while it is possible to read the lyric aloud somewhat insipidly, it is difficult to take the sound note information into account, such as to change the voice pitch or the duration of the uttered speech.

SUMMARY OF THE INVENTION

It is therefore an object of the present invention to provide a speech synthesis method, a speech synthesis apparatus, a program, and a recording medium for synthesizing the sentence or the singing by a natural speech or voice close to the human voice, and a robot apparatus outputting the speech, in which it is possible to synthesize a sentence or a singing with a natural speech close to the human voice.

For accomplishing the above object, the speech synthesis method and apparatus according to the present invention separate a singing data portion, specified by a singing tag, and the other portion or the text portion, from an input text, form singing metrical data for the singing data, form a speech symbol sequence for the text portion, form metrical from the speech symbol sequence, and synthesize the speech based on the singing metrical data or the metrical data. In this manner, a sentence or a singing may be synthesized with a natural speech close to the human voice.

The speech synthesis method and apparatus according to the present invention also are supplied with singing data of a preset format representing the singing, and form the singing metrical data from the singing data, to synthesize the speech based on the singing metrical data. In this manner, a sentence or a singing may be synthesized with a natural speech close to the human voice.

The program according to the present invention allows a computer to execute the above-described speech synthesis processing. The recording medium according to the present invention is computer-readable and includes this program recorded thereon.

With the program and the recording medium, the singing data portion, specified by the singing tag, and the other or text portion, are separated from the input text, and the speech is synthesized based on the singing metrical data associated with the singing data, and metrical data, associated with the other portion of the text portion, or singing data of a preset format representing the singing is input and the speech is synthesized based on the singing metrical data prepared from the singing data, whereby the sentence or the singing may be synthesized with a natural speech close to the human voice.

The robot apparatus according to the present invention is an autonomous robot apparatus for performing a behavior based on the input information supplied thereto, comprises separating means for separating, from an input text, a singing data portion specified by a singing tag and the other text portion, singing metrical data forming means for forming singing metrical data from the singing data, speech symbol sequence forming means for forming a speech symbol sequence for the text portion, metrical data forming means for forming metrical data from the speech symbol sequence and speech synthesis means for synthesizing the speech based on the singing metrical data or the metrical data. In this manner, the sentence or the singing may be synthesized with a natural speech close to the human voice, while the entertainment performance and the friendly relationship to the human being of the robot apparatus are also improved.

BRIEF DESCRIPTION OF THE DRAWINGS

FIG. 3 shows an illustrative structure of a natural metrical dictionary in the speech synthesis apparatus.

FIG. 12 shows a status transition table provided in each node of the finite probability automaton.

DESCRIPTION OF THE PREFERRED EMBODIMENTS

Figure 1:
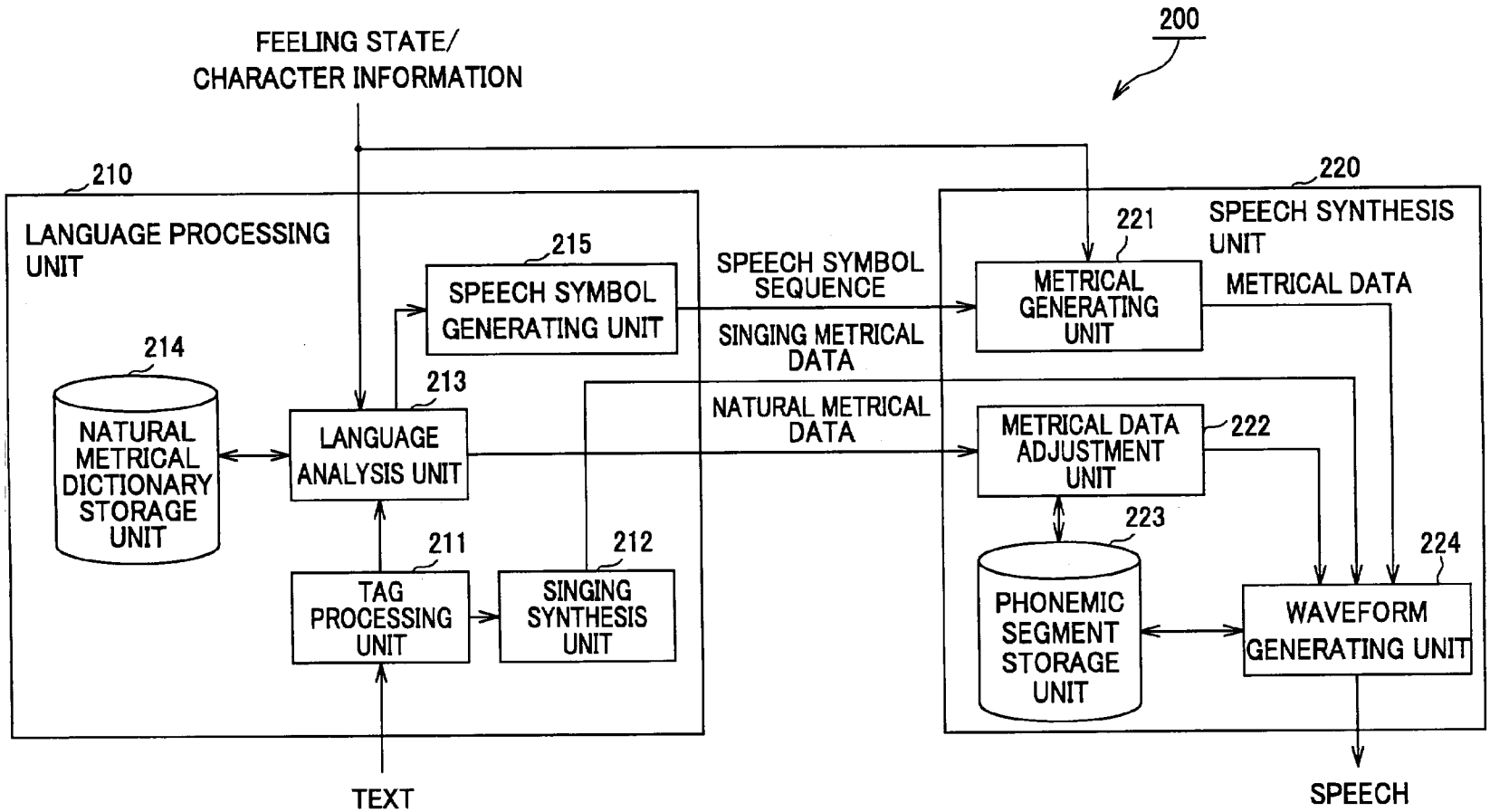
FIG. 1 illustrates a schematic structure of a speech synthesis apparatus embodying the present invention.

Referring to the drawings, preferred embodiments of the present invention will be explained in detail.

FIG. 1 shows a schematic structure of a speech synthesis apparatus embodying the present invention. Although it is here assumed that the speech synthesis apparatus is to be applied to such as a robot apparatus having at least a feeling model, speech synthesis means and speech uttering means, the apparatus may, of course, be applied to a variety of robot apparatus or a variety of computer AI (artificial intelligence) different than a robot. Moreover, although it is assumed that it is the Japanese words or sentences that are to be synthesized by the speech synthesis apparatus, the apparatus may be applied to languages other than Japanese.

Referring to FIG. 1, the speech synthesis apparatus 200 is made up by a language processing unit 210 and a speech synthesis unit 220. The language processing unit 210 includes a tag processing unit 211, a singing synthesis unit 212, a language analysis unit 213, a natural metrical dictionary storage unit 214 and a speech symbol generating unit 215. The speech synthesis unit 220 includes a metrical generating unit 221, a metrical data adjustment unit 222, a phonemic segment storage unit 223 and a waveform generating unit 224.

In the language processing unit 210, the tag processing unit 211 analyzes the input text and sends the text of the input text portion provided with a singing tag to the singing synthesis unit 212. The tag processing unit 211 divides the input text portion, provided with a tag other than the singing tag, into the ordinary text portion and the tag, and sends the text portion to the language analysis unit 213, while sending the tag information to the language analysis unit 213. If the input text is not provided with a tag, the tag processing unit 211 sends the input text directly to the language analysis unit 213. It is noted that the singing tag specifies that the singing data delimited by a beginning tag and an end tag is to be ultimately expressed as singing, by attaching the melody to the ultimately synthesized speech, and that other tags specify that various feelings and character-related properties shall be afforded to the ultimately synthesized speech, as will be explained subsequently in detail.

The singing synthesis unit 212 forms singing metrical data from the singing data delimited between the singing tags in the text. The singing data specifies music representations, such as pitch or duration of respective notes in a score, lyric accorded to the notes, rests, tempo or loudness, by tags. Based on the singing data, the singing synthesis unit 212 forms singing metrical data expressing such parameters as pitch period, duration or sound volume of the respective phonemes representing the lyric. In forming the singing metrical data, the pitch period, for example, may be varied in short periods to produce "vibrato" in the synthesized singing. The singing synthesis unit 212 sends this singing metrical data to the waveform generating unit 224.

The language analysis unit 213 performs language processing on the text portions, supplied from the tag processing unit 211, by having reference to a word dictionary storage unit or to a grammatical rule storage unit. Specifically, there is stored, in the word dictionary storage unit, a word dictionary stating the word information such as the article information, reading or the accentuation information of respective words, while the grammatical rule storage unit holds the grammatical rules, such as constraint on word liaison, for words entered in the word dictionary of the word dictionary storage unit. Based on this word dictionary and the grammatical rule, the language analysis unit 213 performs analyses, such as morpheme analyses or analyses of sentence structures, of the text portions of the input text supplied from the tag processing unit 211. As for the words or sentences registered in the natural metrical dictionary of the natural metrical dictionary storage unit 214, the language analysis unit 213 refers to the tag information to select the natural metrical data registered in the natural metrical dictionary to send the selected data to the metrical data adjustment unit 222 as later explained. The natural metrical dictionary and the natural metrical data will be explained subsequently in detail. As for the words or sentences not registered in the natural metrical dictionary of the natural metrical dictionary storage unit 214, the results of the analysis are sent to the speech symbol generating unit 215.

The speech symbol generating unit 215 refers to the rules for accentuation and phrasing to generate a speech symbol sequence, corresponding to the text, based on the results of analysis supplied from the language analysis unit 213. The rules for accentuation mean rules for affording accents and, in accordance with these rules for accentuation, the speech symbol generating unit 215 inserts tags representing the accents to the speech symbols. The rules for phrasing mean the rules in locating phrases and, in accordance with these rules for phrasing, the speech symbol generating unit 215 inserts tags representing the phrases.

In the speech synthesis unit 220, the metrical generating unit 221 generates metrical data, based on the speech symbol sequence supplied from the speech symbol generating unit 215, to send the metrical data to the waveform generating unit 224. The metrical generating unit 221 generates the metrical data, expressing such as pitch period of the phonemes, duration or sound volume, by a statistic technique such as quantification method of the first type, using the information extracted from the speech symbol sequence, such as accent type, number of accentuated phrases in the sentence, the position of the accentuated phrases in the sentence, number of phonemes in the accentuated phrases, the position of the phonemes in the accentuated phrase or the phoneme type.

If the pitch period, speech tempo or the sound volume is set by the application, the metrical generating unit 221 takes these into account to adjust the parameters of the metrical data. The metrical generating unit 221 adjusts the parameters of the metrical data based on the tag information to enable synthesis of the speech with attendant feeling or character-related properties.

The metrical data adjustment unit 222 acquires data such as the mean pitch period of the speech, mean speech tempo or mean sound volume of the speech output as standard, from the phonemic segment storage unit 223, to adjust the pitch period, duration or the sound volume so that the parameters of the natural metrical data supplied from the language analysis unit 213 will be equal to the mean values mentioned above. If the pitch period, speech tempo or the sound volume is specified by the application, the metrical data adjustment unit 222 takes this into account to adjust the parameters of the natural metrical data.

The waveform generating unit 224 generates the speech waveform, using the metrical data supplied from the metrical generating unit 221, natural metrical data supplied from the metrical data adjustment unit 222 and the singing metrical data supplied from the singing synthesis unit 212. The waveform generating unit 224 refers to the phonemic segment storage unit 223 and, based on such parameters as pitch period, duration or the sound volume indicated in the metrical data, natural metrical data or the singing metrical data, and on the phonemic sequence, retrieves the phonemic segment with parameters as close to these as possible to slice and array these portions to generate speech waveform data. That is, phonemic segment data are stored as CV (consonants, vowels), VCV or CVC in the phonemic segment storage unit 223, and the waveform generating unit 224 concatenates necessary phonemic segment data, based on the metrical data, natural metrical data or singing metrical data, while properly adding pauses, accents or intonations, etc., to generate speech waveform data.

The produced speech waveform data are sent to a loudspeaker through a D/A (digital/analog) converter or amplifier so as to be uttered as actual speech. With a robot apparatus, this processing is executed by a so-called virtual robot and the resulting speech is uttered over a loudspeaker.

Figure 2:
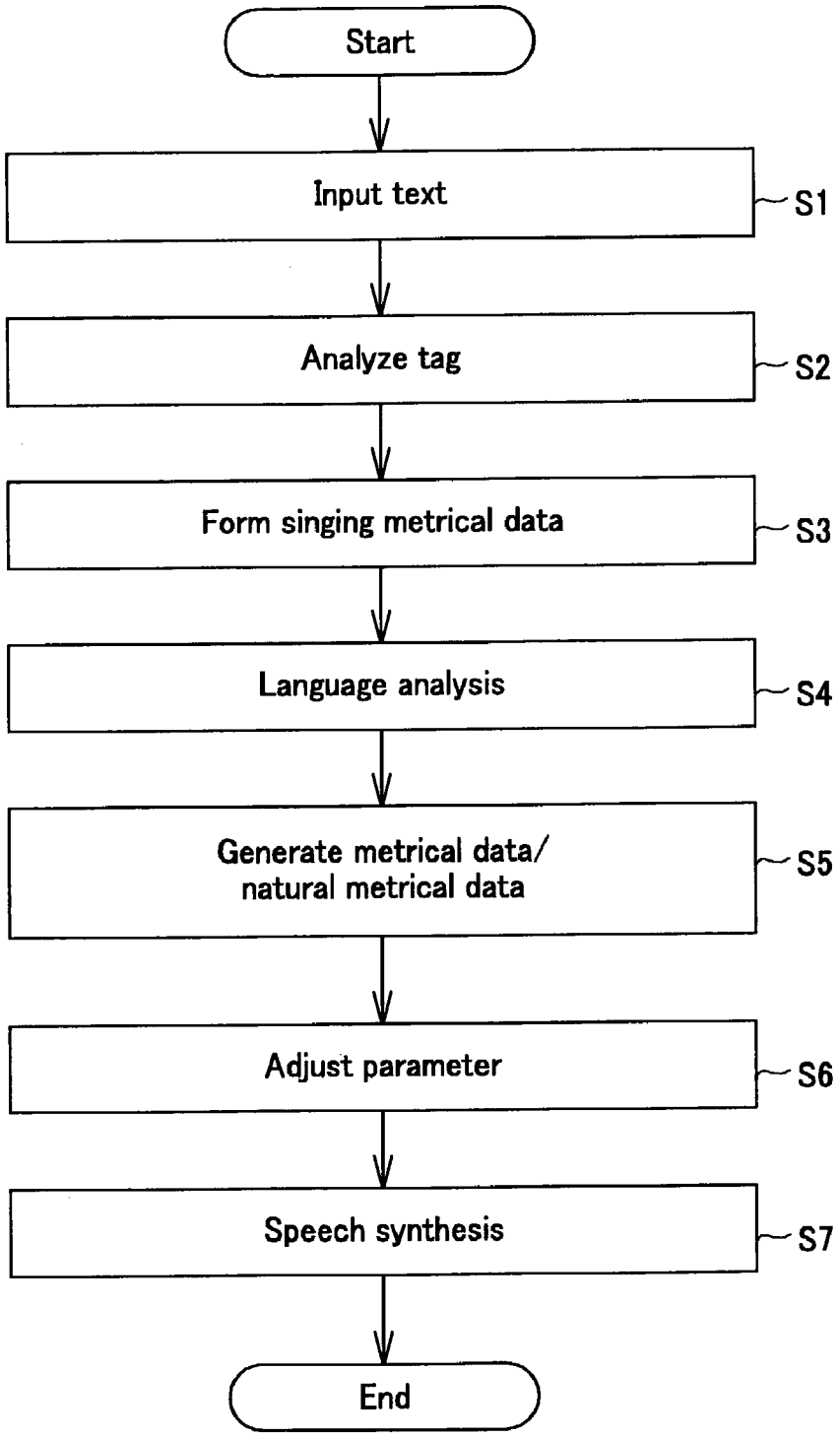
FIG. 2 is a flowchart illustrating the operation of the speech synthesis apparatus.

The operation of the above-described speech synthesis apparatus 200 is now explained, using the flowchart of FIG. 2. First, in a step S1, a text for uttering is input and, in a step S2, the tag is analyzed. If no tag is provided to the input text, the step S2 may be omitted.

In the next step S3, the singing metrical data is generated. That is, from the singing data delimited between tags indicating the beginning and the end of the singing in the text, the singing metrical data expressing such parameters as the pitch period, duration or the sound volume of the respective phonemes expressing the lyric, are generated. The pitch period, for example, may be varied in short periods to produce "vibrato" in the synthesized singing. If no tag is provided to the input text, the step S3 may be omitted.

In the next step S4, language processing is carried out for the text portion different than the singing data mentioned above. That is, for the text portions of the input text different than the singing data, analysis, such as morpheme analysis or analysis of sentence structures, are carried out, based on the word dictionary stating the article information, reading or accents of respective words, and on the grammatical rules such as constraint pertinent to word concatenations, as mentioned above.

In a step S5, metrical data or natural metrical data are generated. That is, for words registered in the natural metrical dictionary in a text portion on which language processing was carried out in the step S4, those natural metrical data registered in the natural metrical dictionary and which are specified by the tags mentioned above are selected. For words not registered in the natural metrical dictionary, metrical data are generated after conversion to a speech symbol sequence.

In a step S6, parameters of the metrical or natural metrical data are adjusted. Specifically, since the natural metrical data are of the pitch period, duration and sound volume as registered in the natural metrical dictionary, the mean pitch period, mean speech tempo, mean sound volume, or the like data for standard output are obtained from the phonemic segment data to adjust the parameters of the natural metrical data. In the step S6, the parameters of the metrical data are adjusted based on the tag information. This allows the synthesized speech to be accompanied by the feeling or character-related properties. In the step S6, if the pitch period, speech tempo or the sound volume is specified by the application, these are taken into account for adjusting the parameters of the metrical data or the natural metrical data.

Finally, in the step S7, speech waveform data are generated using the metrical data, natural metrical data and the singing metrical data. That is, the necessary phonemic segment data are concatenated based on the metrical data, natural metrical data and the singing metrical data, and further the pause, accentuation or intonation are suitably accorded to generate speech waveform data. These speech waveform data are sent via a D/A converter or an amplifier to a loudspeaker so that the sentences or the singing is emitted as actual speech.

Meanwhile, the sequence of the respective steps in the above flowchart are only for convenience for explanation such that the processing is not necessarily carried out in this sequence. That is, the text portion of the input text delimited between singing tags is processed as shown in step S3, while the remaining text portion is processed as shown in steps S4 to S6.

The speech synthesis apparatus 200, shown in the present embodiment, forms singing metrical data representing such parameters as pitch period, duration or the sound volume of respective phonemes expressing the lyric, for the singing data portion in the text. The speech synthesis apparatus 200 registers various words or sentences in the natural metrical dictionary in advance, performs language processing on the text portions other than the singing data, and selects, for the word or sentences registered in the natural metrical dictionary, the natural metrical data registered in the natural metrical dictionary. For non-registered words or sentences, the speech synthesis apparatus 200 generates a speech symbol sequence and subsequently generates metrical data, as in the case of synthesis of routine text speech synthesis. Based on the metrical data, natural metrical data and the singing metrical data, the speech synthesis apparatus 200 concatenates necessary phonemic segments together, while suitably adding pauses, accentuation or intonation, to generate speech waveform data.

That is, since the singing data are expressed with the same text form as that of the other text portions, the singing may be emitted without using dedicated interfaces or speech synthesis engines.

Moreover, since the metrical data of words or sentences not registered in the natural metrical dictionary and the natural metrical data of words or sentences registered therein are concatenated together based on such parameters as the pitch period, duration or the sound volume, it is possible to synthesize the speech with excellent spontaneity.

The operation of the speech synthesis apparatus 200 is hereinafter explained by giving a specified example. For convenience sake, the following explanation is made for a case where the speech of the singing data portions in the text is synthesized and for a case where the other text portions are synthesized.

First, the case of forming the singing metrical data corresponding to the singing data portion is explained. Here, as an example of the singing to be synthesized, [momotaro-san, momotaro-san] as a beginning portion of a song of an old folk lore [Momo-taro] is used.

The singing data is represented as a portion delimited between a tag ¥song¥, indicating the beginning of singing data, and a tag ¥¥song¥, indicating the end thereof, as shown for example in the following table:

TABLE 1

| |
|---|
| ¥song¥ |
| ¥dyna mf¥ |
| ¥speed 120¥ |
| ¥G4, 4+8¥ mo |
| ¥A4, 8¥ mo |
| ¥G4, 8+16¥ ta |
| ¥G4, 16¥ ro |
| ¥E4, 8¥ sa |
| ¥E4, 8¥ n |
| ¥G4, 8+16¥ mo |
| ¥G4, 16¥ mo |
| ¥E4, 8+16¥ ta |
| ¥C4, 16¥ ro |
| ¥D4, 8¥ sa |
| ¥D4, 8¥ n |
| ¥PP, 4¥ |
| ¥¥ song¥ |

In the above table, [¥dyna mf¥] indicates that the sound volume of this singing is mf (mezoforte). The next following [¥speed 120¥] indicates that this singing is a tempo of 120 quarter notes per minute. The relevant portion of the actual lyric is expressed for example as [¥G4, 4+8¥mo], where [G4] denotes the pitch of the sound note, [4+8] indicates that the sound note is of the duration of one quarter note and one eighth note, that is dotted quarter note, and [mo] indicates that the lyric for this sound note is [mo]. The [¥PP, 4¥] indicates a quarter rest. In this manner, the pitch and the duration of respective sound notes in a musical score, the lyric attached to the sound notes, rests, tempo or the loudness are expressed.

The singing data, expressed in this manner, are converted into singing metrical data by singing synthesis unit 212. The singing metrical data are expressed as indicated for example in the following table:

TABLE 2

| [LABEL] | | [PITCH] | | [VOLUME] | |
|---|---|---|---|---|---|
| 0 | mo | 0 | 56 | 0 | 66 |
| 1000 | oo | 1000 | 56 | 72669 | 57 |
| 14337 | om | 2000 | 59 | 73169 | 48 |
| 16537 | mo | 4009 | 52 | 73669 | 39 |
| 17537 | o | 6009 | 59 | 74169 | 30 |
| 19849 | ot | 8012 | 52 | 74669 | 21 |
| 22049 | ta | 10012 | 59 | 75169 | 12 |
| 23049 | aa | 12026 | 52 | 75669 | 3 |
| 29317 | ar | 14026 | 59 | 84694 | 5 |
| 30317 | ro | 14337 | 56 | 85194 | 5 |
| 31695 | os | 16537 | 50 | 85694 | 5 |
| 33073 | sa | 17537 | 50 | 86194 | 5 |
| 34073 | aa | 19849 | 50 | 86694 | 5 |
| 36385 | ax | 22049 | 56 | 87194 | 5 |
| 38585 | xx | 23049 | 56 | 87694 | 5 |
| 39585 | xx | 24049 | 59 | | |
| 41897 | xm | 26050 | 52 | | |
| 44097 | mo | 28050 | 59 | | |
| 45097 | oo | 29317 | 56 | | |
| 51365 | om | 30317 | 56 | | |
| 52365 | mo | 31695 | 56 | | |
| 53743 | ot | 33073 | 67 | | |
| 55121 | ta | 34073 | 67 | | |
| 56121 | aa | 36385 | 67 | | |
| 62389 | ar | 38585 | 67 | | |
| 63389 | ro | 39585 | 67 | | |

TABLE 2-continued

| [LABEL] | | [PITCH] | | [VOLUME] |
|---|---|---|---|---|
| 64767 | os | 41897 | 67 | |
| 66145 | sa | 44097 | 56 | |
| 67145 | aa | 45097 | 56 | |
| 69457 | ax | 46097 | 59 | |
| 71657 | xx | 48103 | 52 | |
| 72657 | xx | 50103 | 59 | |
| 72669 | xx | 51365 | 56 | |
| 73169 | xx | 52365 | 56 | |
| 73669 | xx | 53743 | 56 | |

| [LABEL] | | [PITCH] | | [VOLUME] |
|---|---|---|---|---|
| 75169 | xx | 57121 | 71 | |
| 75669 | xx | 59123 | 62 | |
| 76169 | x. | 61123 | 71 | |
| 77169 | pp | 62389 | 67 | |
| 77169 | pp | 63389 | 84 | |
| | | 64767 | 84 | |
| | | 66145 | 75 | |
| | | 67145 | 75 | |
| | | 69457 | 75 | |
| | | 71657 | 75 | |
| | | 72657 | 75 | |
| | | 76169 | 75 | |
| | | 77169 | 0 | |
| | | 77169 | 0 | |

In the above Table, [LABEL] indicates the duration of each phoneme. That is, the phoneme [mo] is the duration of 1000 samples from sample 0 to sample 1000, while the phoneme [oo] is the duration of 13337 samples from sample 1000 to sample 14337. The [PITCH] is the pitch period, expressed by dot pitch. That is, the pitch period at sample 0 and that at sample 1000 is 56 samples, while that at sample 2000 is 59 samples. The [VOLUME] indicates the relative sound volume at each sample. That is, if the default value is 100%, the sound volume at sample No.0 is 66%, while that at samples No.72669 is 57%. In this manner, the totality of the phonemes may be expressed.

In preparing the singing metrical data, the pitch period and/or the duration of the respective phonemes may be changed to apply vibrato to the synthesized signing.

As a specified example, the case of elongating the sound note with a pitch of [A4] by a certain time length is explained. The singing metrical data in the absence of the vibrato application may be expressed as indicated by the following Table:

TABLE 3

| [LABEL] | | [PITCH] | | [VOLUME] | |
|---|---|---|---|---|---|
| 0 | ra | 0 | 50 | 0 | 66 |
| 1000 | aa | | | 39600 | 57 |
| 39600 | aa | | | 40100 | 48 |
| 40100 | aa | | | 40600 | 39 |
| 40600 | aa | | | 41100 | 30 |
| 41100 | aa | | | 41600 | 21 |
| 41600 | aa | | | 42100 | 12 |
| 42100 | aa | | | 42600 | 3 |
| 42600 | aa | | | | |
| 43100 | a. | | | | |

If the vibrato is to be applied, the following tags are added to the singing data:

TABLE 4

| |
|---|
| ¥vib_rat=2000¥ |
| ¥vib_dep=6¥ |
| ¥vib_del=1000¥ |
| ¥vib_length=6000¥ |

In the above Table, [¥vib_rat=2000¥] means that the vibrato in this singing has a width of 2000 samples, while [¥vib_dep=6¥] indicates that the vibrato has a depth of 6%. That is, the pitch period as a reference is varied in a range of ±6%. On the other hand, [¥vib_del=1000¥] indicates that the delay until the beginning of the vibrato is 1000 samples. That is, vibrato begins to be applied after 1 passage through 1000 samples. The [¥vib_length=6000¥] means that the minimum value of the length of the sound notes to which the vibrato is to be applied is 6000 samples. That is, the vibrato is applied only to the sound notes with the length of not less than 6000 samples.

By the above-mentioned tags of the singing data, the following singing metrical data are prepared:

TABLE 5

| [LABEL] | | [PITCH] | | [VOLUME] | |
|---|---|---|---|---|---|
| 0 | ra | 0 | 50 | 0 | 66 |
| 1000 | aa | 1000 | 50 | 39600 | 57 |
| 11000 | aa | 2000 | 53 | 40100 | 48 |
| 21000 | aa | 4009 | 47 | 40600 | 39 |
| 31000 | aa | 6009 | 53 | 41100 | 30 |
| 39600 | aa | 8010 | 47 | 41600 | 21 |
| 40100 | aa | 10010 | 53 | 42100 | 12 |
| 40600 | aa | 12011 | 47 | 42600 | 3 |
| 41100 | aa | 14011 | 53 | | |
| 41600 | aa | 16022 | 47 | | |
| 42100 | aa | 18022 | 53 | | |
| 42600 | aa | 20031 | 47 | | |
| 43100 | a. | 22031 | 53 | | |
| | | 24042 | 47 | | |
| | | 26042 | 53 | | |
| | | 28045 | 47 | | |
| | | 30045 | 53 | | |
| | | 32051 | 47 | | |
| | | 34051 | 53 | | |
| | | 36062 | 47 | | |
| | | 38062 | 53 | | |
| | | 40074 | 47 | | |
| | | 42074 | 53 | | |
| | | 43100 | 50 | | |

Although the vibrato is specified by the tags of the singing data, this is merely illustrative, such that vibrato may be automatically applied when the length of the sound notes has exceeded a preset threshold value.

The case of generating metrical data and the natural metrical data associated with the text portions different than the singing data is hereinafter explained. It is assumed that [¥happiness¥ say, the weather is fine today] is used as an example of the text portion and that [say] in the text has been registered in the natural metrical dictionary. It is noted that ¥happiness¥ is a tag meaning that the text is to be synthesized with a feeling of happiness. Of course, the tag is not limited to this example and moreover may specify the feeling other than happiness. A tag specifying a character may also be attached in place of the tag specifying the feeling, or even no tag may be used.

The ordinary text portion provided with the tag is separated in the tag processing unit 211 (FIG. 1) into the tag (¥happiness¥) and the text (say, the weather is fine today). The tag information and the text are supplied to the language analysis unit 213.

The text portion is subjected to language analysis in the language analysis unit 213 as reference is had in the language analysis unit 213 to the natural metrical dictionary in the natural metrical dictionary storage unit 214. The natural metrical dictionary is constructed as shown for example in FIG. 3. As shown therein, variable feelings, such as calmness, anger, sadness, happiness or comfort, and natural metrical data associated with respective characters, are provided for respective registered words, in addition to the standard natural metrical data.

It is noted that the examples of the feelings are not limited to the above recited feelings, while it is unnecessary to provide natural metrical data associated with the totality of the feelings for respective words. If no natural metrical data associated with the specified feelings are registered, standard natural metrical data may be provided, while natural metrical data, such as analogous feelings, may also be selected. Since it is known that, for specified sets of feelings, such as surprise and fear or boredom and sadness, the uttered speeches are analogous in acoustic characteristics, substitute natural metrical data may also be used.

Since the tag (¥happiness¥) is appended to the text portion in the present embodiment, the natural metrical data [say] corresponding to happiness is selected. This natural metrical data is expressed for example as shown in the following Table:

TABLE 6

| [LABEL] | | [PITCH] | | [VOLUME] | |
|---|---|---|---|---|---|
| 0 | .n | 0 | 76 | 0 | 100 |
| 807 | ne | 4274 | 47 | 807 | 121 |
| 4269 | e. | 6618 | 106 | 4269 | 101 |
| 9596 | .. | | | 9596 | 69 |

On the other hand, since the input text portion [the weather is fine today] is not registered in the natural metrical data, it is sent to the speech symbol generating unit 215 for conversion to a speech symbol sequence exemplified by [Ko'5oowa//te'4xxkiva//yo'2iine..], where ['] in the tag ['5] means an accent, the next number 5 means the strength of the accent, and the tag [//] means a division for the accentuated phrase.

The speech symbol sequence thus generated is converted into metrical data in the metrical generating unit 221. These metrical data are of the structure similar to that of the natural metrical data mentioned above and are expressed by the [LABEL] expressing the duration of each phoneme, the [PITCH] expressing the pitch period by the dot pitch and by the [VOLUME] expressing the relative sound volume in each sample.

Since the tag (¥happiness¥) is appended to the text portion as mentioned above, it is necessary to express the feeling of happiness not only for the text portion [Say,] but also for the text portion [the weather is fine today].

Thus, in the present embodiment, a combination table of parameters predetermined for each feeling, such as anger, sadness, happiness or calm (at least the duration (DUR), pitch (PITCH) and sound volume (VOLUME) of each phoneme) is pre-generated, based on the characteristics of the respective feelings, and stored in the metrical generating unit 221. The pitch unit in the following table is Hertz, with the unit of the duration being milliseconds (msec).

TABLE 7

| calm | |
|---|---|
| parameters | status or value |
| LASTWORDACCENTED | no |
| MEANPITCH | 280 |
| PITCHVAR | 10 |
| MAXPITCH | 370 |
| MEANDUR | 200 |
| DURVAR | 100 |
| PROBACCENT | 0.4 |
| DEFAULTCONTORD | rising |
| CONTOURLASTWORD | rising |
| VOLUME | 100 |

TABLE 8

| anger | |
|---|---|
| parameters | status or value |
| LASTWORDACCENTED | no |
| MEANPITCH | 450 |
| PITCHVAR | 100 |
| MAXPITCH | 500 |
| MEANDUR | 150 |
| DURVAR | 20 |
| PROBACCENT | 0.4 |
| DEFAULTCONTORD | falling |
| CONTOURLASTWORD | falling |
| VOLUME | 140 |

TABLE 9

| sadness | |
|---|---|
| parameters | status or value |
| LASTWORDACCENTED | nil |
| MEANPITCH | 270 |
| PITCHVAR | 30 |
| MAXPITCH | 250 |
| MEANDUR | 300 |
| DURVAR | 100 |
| PROBACCENT | 0 |
| DEFAULTCONTORD | falling |
| CONTOURLASTWORD | falling |
| VOLUME | 90 |

TABLE 10

| comfort | |
|---|---|
| parameters | status or value |
| LASTWORDACCENTED | t |
| MEANPITCH | 300 |
| PITCHVAR | 50 |
| MAXPITCH | 350 |
| MEANDUR | 300 |
| DURVAR | 150 |
| PROBACCENT | 0.2 |
| DEFAULTCONTORD | rising |
| CONTOURLASTWORD | rising |
| VOLUME | 100 |

TABLE 11

| happiness | |
|---|---|
| parameters | status or value |
| LASTWORDACCENTED | t |
| MEANPITCH | 400 |
| PITCHVAR | 100 |
| MAXPITCH | 600 |
| MEANDUR | 170 |
| DURVAR | 50 |
| PROBACCENT | 0.3 |
| DEFAULTCONTORD | rising |
| CONTOURLASTWORD | rising |
| VOLUME | 120 |

The feelings may be expressed by switching the tables, comprised of parameters, associated with respective feelings provided in advance, depending on the actually discriminated feelings, and by changing the parameters based on this table, as described above.

Specifically, the technique stated in the specification and the drawings of the European patent application 01401880.1 may be applied.

For example, the pitch period of each phoneme is changed so that the mean pitch period of the phonemes included in the uttered words will be of a value calculated based on the value of MEAN PITCH, while the variance of the pitch period will be of a value calculated based on the value of PITCHVAR.

In similar manner, control is made such that the duration of each phoneme is changed so that the mean duration of the phonemes making up an uttered word is equal to a value calculated by the value of the MEANDUR, and so that the variance of the duration will be equal to DURVAR.

The sound volume of each phoneme is also controlled to a value specified by the VOLUME in each feeling table.

It is also possible to change the contour of each accented phrase based on this table. That is, with DEFAULTCONTOUR=rising, the pitch gradient of the accented phrase is rising, whereas with DEFAULTCONTOUR=falling, the pitch gradient of the accented phrase is falling.

Meanwhile, if the pitch period, speech tempo or the sound volume is set by an application, the application data may also be used to adjust parameters, such as the pitch period, speech tempo or the sound volume of the metrical data.

On the other hand, as for the natural metrical data for the text portion [say,], the above parameters of the pitch period, duration or the sound volume are adjusted by the metrical data adjustment unit 222. That is, since the natural metrical data are of the pitch period, duration or the sound volume as set at the time of registration in the natural metrical dictionary, the data of the mean pitch period, mean speech tempo or the mean sound volume of the speech, output at a standard, are obtained from phoneme segment data used in the waveform generating unit 224, by way of adjusting the parameters of the natural metrical data.

Since the mean pitch period of the metrical data has been modified so that the mean pitch period will be the mean pitch period of the table associated with the feeling of happiness, as described above, the mean pitch period of the natural metrical data is also adjusted to be the mean pitch period of the table.

Moreover, if the pitch period, speech tempo or the sound volume is set by an application, the application data may also be used to adjust the parameters of the natural metrical data.

The singing metrical data, obtained as described above, and the metrical and natural metrical data, changed in the parameters, are sent to the waveform generating unit 224, where speech waveform data are generated from these data. That is, the speech waveform data are synthesized by concatenating necessary phoneme segment data, based on the metrical data, natural metrical data and the singing metrical data, and also by properly appending pauses, accents or intonation. The speech waveform data are sent to a loudspeaker via a D/A converter or an amplifier and emitted as actual speech.

In the above explanation, the singing synthesis unit 212 sends the formed singing metrical data to the waveform generating unit 224. Alternatively, the formed singing metrical data may also be sent to for example the metrical data adjustment unit 222 for adjusting the parameters within the scope of the present invention. This allows to lower the pitch of the male voice by one octave, for example.

The above explanation is directed to a case in which the synthesized speech of the text portion other than the singing data is accompanied by the feeling or the character-related properties specified by tags. Alternatively, the synthesized speech may be accompanied by the feeling or character-related properties as specified by the feeling state information or the character information applied from outside.

Taking an example of the feeling, a robot apparatus, for example, internally has a probability state transition model (e.g., a model having a status transition table, as subsequently described) as a behavioral model, in which each state has a different transition probability table depending on the results of the recognition, feeling values or instinct values, such that transition to the next state occurs depending on the probability, to output a behavior correlated with this transition.

The behavior of expressing happiness or sadness by the feeling is stated in this probability status transition model or probability transition table. One of the expressing behaviors is that by speech (utterance).

That is, in this robot apparatus, one of the elements of a behavior determined by the behavioral model referring to the parameters expressing the feeling state of the feeling model, is the feeling expression, and the feeling state is discriminated as a partial function of an behavior decision unit. The so discriminated feeling state information is sent to the aforementioned language analysis unit 213 and to the metrical generating unit 221. This selects the natural metrical data corresponding to the feeling, while adjusting the parameters of the metrical data and the natural metrical data depending on these feelings.

An instance of applying the present invention to a two-legged autonomous robot, as typical of this robot apparatus, is now explained in detail by referring to the drawings. The feeling and instinct model is introduced to a software of this humanoid robot apparatus to achieve a behavior closer to that of the human being. While the present embodiment uses a robot actually performing the behavior, speech utterance is easily possible with a computer having a loudspeaker and represents an effective function in the field of interaction (or dialog) between the human being and a machine. Consequently, the application of the present invention is not limited to a robot system.

Figure 4:
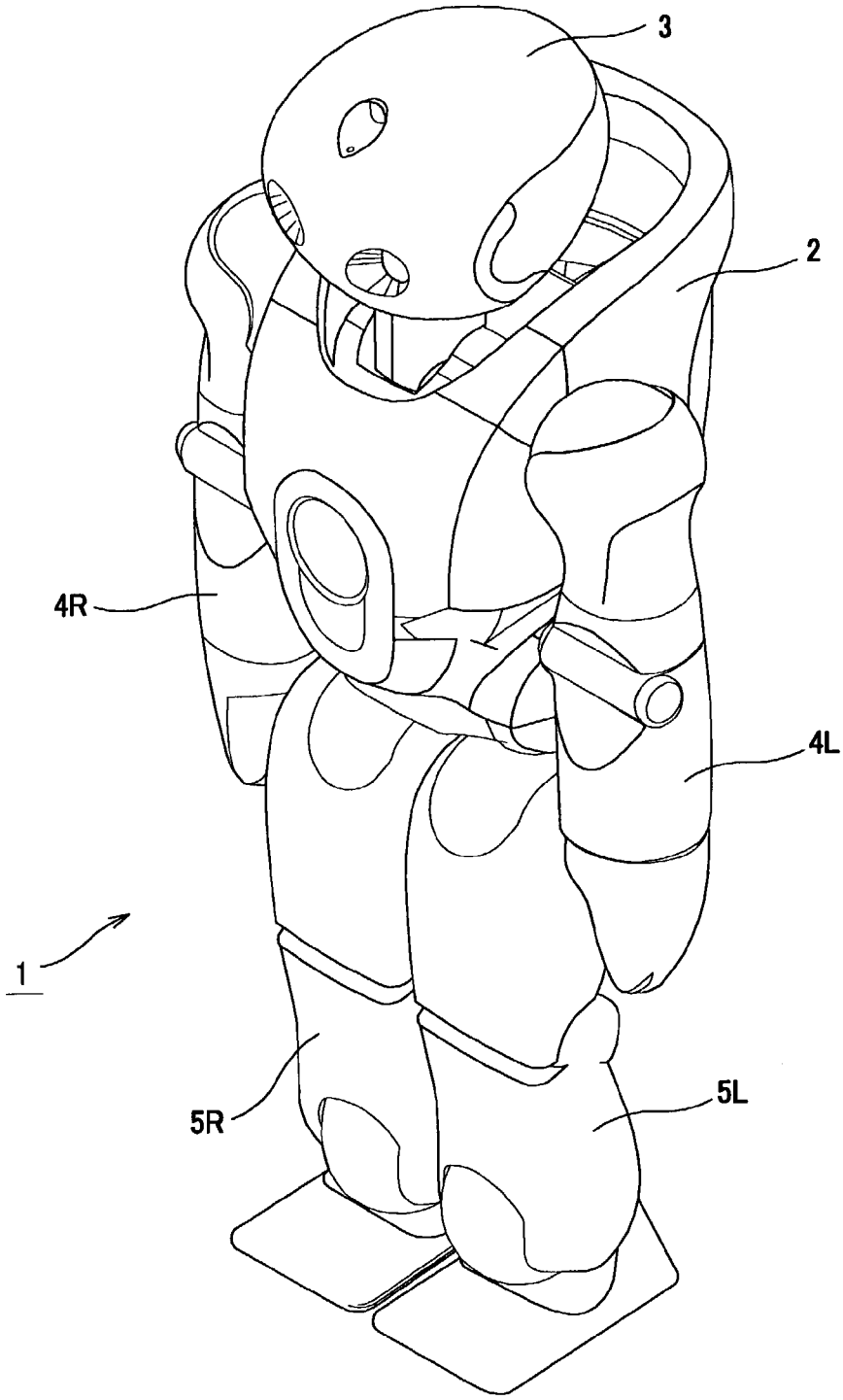
FIG. 4 is a perspective view of a robot apparatus embodying the present invention.

As a specified example, the humanoid robot apparatus, shown in FIG. 4, is a practical robot supporting the human activities in various situations in our everyday life, such as in the living environment of the human being. Moreover, the humanoid robot apparatus is an entertainment robot that is able to demonstrate the behaviors depending on the inner state (e.g., anger, sadness, happiness, joy) and the basic behaviors performed by the human being.

Referring to FIG. 4, the robot apparatus 1 is made up by a body trunk unit 2, to preset positions of which are connected a head unit 3, left and right arm units 4R/L and left and right leg units 5R/L, where R and L denote suffices indicating left and right, respectively, hereinafter the same.

Figure 5:
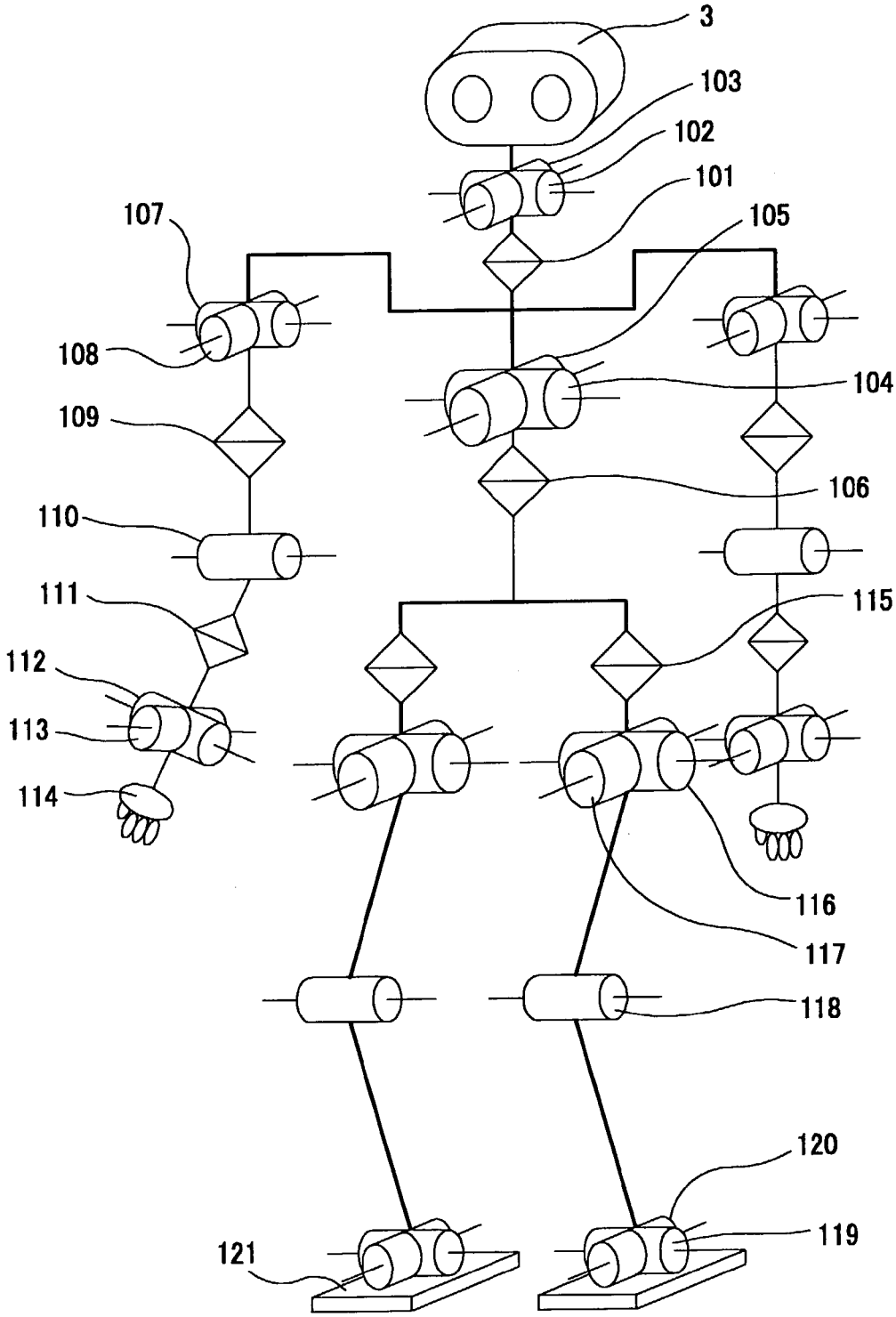
FIG. 5 is a schematic view showing a freedom degree constituting model of the robot apparatus.

FIG. 5 schematically shows the structure of the degree of freedom of joints equipped on the robot apparatus 1. A neck joint, supporting the head unit 3, includes a neckjoint yaw axis 101, a neckjoint pitch axis 102 and a neckjoint roll axis 103 and thus has three degrees of freedom.

The respective arm units 4R/L, constituting the upper limbs, are made up by a shoulder joint pitch axis 107, a shoulder joint roll axis 108, an upper arm yaw axis 109, a hinge joint pitch axis 110, a forearm yaw axis 111, a wrist joint pitch axis 112, a wrist joint roll axis 113 and a hand unit 114. This hand unit 114 is actually a multi-joint multi-degree-of-freedom structure including plural fingers. However, the operation of the hand 114 contributes to or influences the orientation or walking control of the robot apparatus 1, only to a lesser extent, and hence the hand unit 114 is assumed in the present specification to be of a zero degree of freedom. Thus, the respective arm units are assumed to have each seven degrees of freedom.

The body trunk unit 2 has three degrees of freedom, namely a body trunk pitch axis 104, a body trunk roll axis 105 and a body trunk yaw axis 106.

The respective leg units 5R/L, constituting the lower limbs, are each made up by hip joint yaw axis 115, a hip joint pitch axis 116, a hip joint roll axis 117, a knee joint pitch axis 118, an ankle joint pitch axis 119, an ankle joint roll axis 120 and a foot unit 121. In the present specification, the point of intersection between the hip joint pitch axis 116 and the hip joint roll axis 117 defines the hip joint position of the robot apparatus 1. The foot unit 121 of the human body is actually a multi-joint and a multi-degree of-freedom foot sole structure. However, the foot sole of the robot apparatus 1 is assumed to be of a zero degree of freedom. Thus, the respective leg units are assumed to have each six degrees of freedom.

To summarize, the robot apparatus 1 in its entirety has a sum total of $3+7\times2+3+6\times2=32$ degrees of freedom. However, it is to be noted that the number of the degree of freedom of the entertainment-oriented robot apparatus 1 is not necessarily limited to 32, and that the number of the degrees of freedom, that is the number of joints, can be suitably increased or decreased, depending on the designing and production constraints or on the design parameters required of the robot apparatus.

The respective degrees of freedom owned by the robot apparatus 1 are actually implemented by actuators. These actuators are desirably small-sized and lightweight from the perspective of a demand for approximating the outer shape of the robot apparatus 1 to the human body by eliminating excess outward protrusion on and for achieving orientation control against the unstable structure imposed by two-legged walking.

Figure 6:
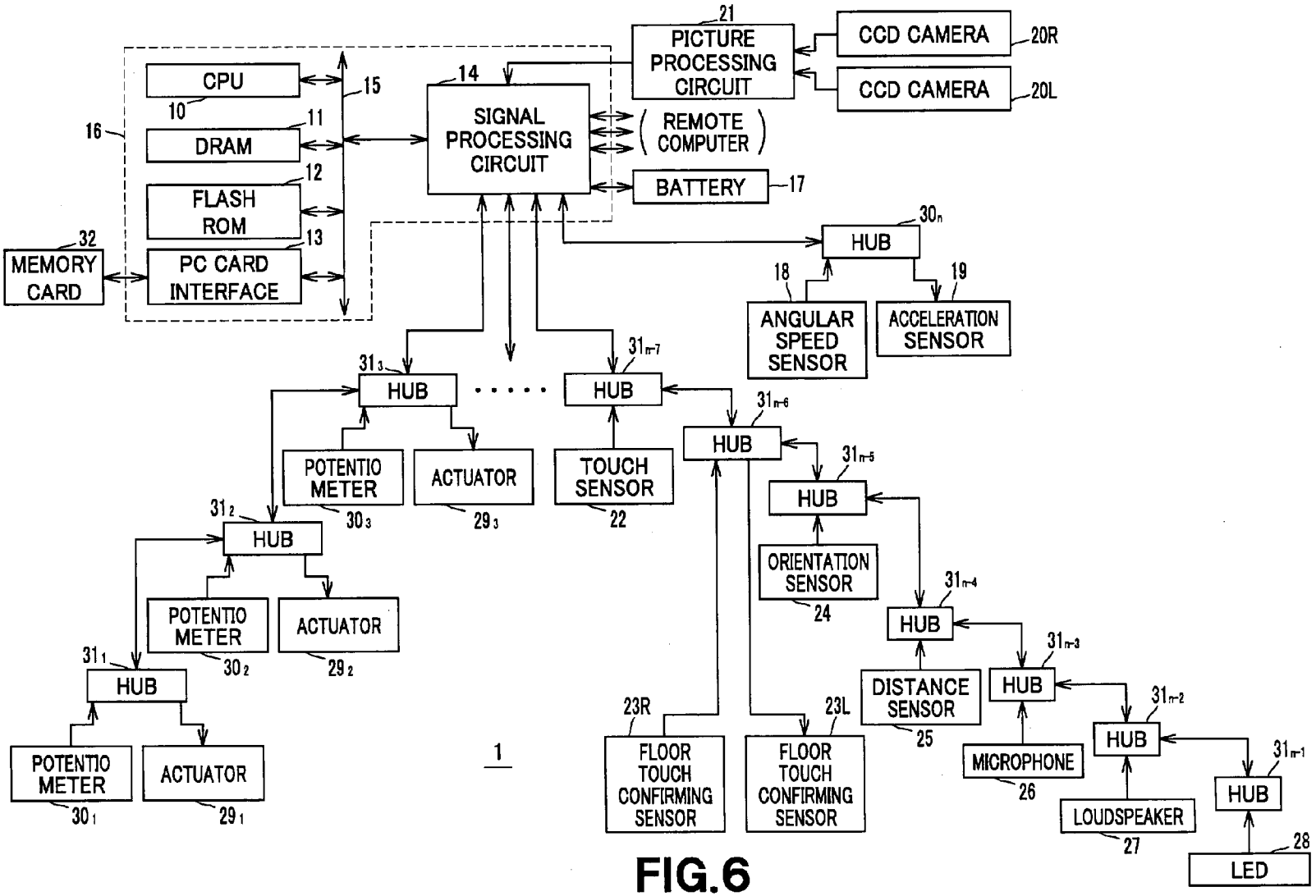
FIG. 6 is a block diagram showing a circuit structure of the robot apparatus.

FIG. 6 schematically shows a control system structure of the robot apparatus 1. As shown in FIG. 6, there are accommodated, within the body trunk unit 2, a controlling unit 16 comprised of a CPU (central processing unit) 10, a DRAM (dynamic random access unit) 11, a flash ROM (read-only memory) 12, a PC (personal computer) card interfacing circuit 13 and a signal processing circuit 14, interconnected over an internal bus 15, and a battery 17 as a power supply for the robot apparatus 1. Also accommodated within the body trunk unit 2 are an angular speed sensor 18 and an acceleration sensor 19 for detecting the orientation or the acceleration of movement of the robot apparatus 1.

On the head unit 3 are arranged a CCD (charge coupled device) cameras 20R/L equivalent to left and right [eyes] for imaging external scenes, a picture processing circuit 21 for forming stereo picture data based on picture data from the CCD cameras 20R/L, a touch sensor 22 for detecting the pressure applied by physical behaviors from a user, such as stroking or patting, floor touch confirming sensors 23R/L for detecting whether or not the foot soles of the leg units 5R/L have touched the floor, an orientation sensor 24 for measuring the orientation, a distance sensor 25 for measuring the distance to an object lying ahead, a microphone 26 for collecting the external sound, a loudspeaker 27 for outputting the voice, such as speech, and an LED (light emitting diode) 28, at preset positions respectively.

The floor touch confirming sensors 23R/L are constituted by for example a proximity sensor or a micro-switch, provided on a foot sole. The orientation sensor 24 is constituted by for example a combination of the acceleration sensor and a gyro sensor. Based on the outputs of the floor touch confirming sensors 23R/L, it can be discriminated whether the left and right leg units 5R/L are currently in the stance position or in the flight position during the behavior such as walking or running. Moreover, the tilt or orientation of the body trunk unit can be detected from an output of the orientation sensor 24.

The joint portions of the body trunk unit 2, left and right arm units 4R/L and the left and right leg units 5R/L are also provided with a number of actuators $\mathbf{29}_1$ to $\mathbf{29}_n$ and a number of potentiometers $\mathbf{30}_1$ to $\mathbf{30}_n$ corresponding to the number of the degrees of freedom mentioned above. For example, the actuators $\mathbf{29}_1$ to $\mathbf{29}_n$ include servo-motors as constituent elements. By the actuation of the servo motors, the left and right arm units 4R/L and the left and right leg units 5R/L undergo transition in a controlled manner to the target orientation or operations.

The various sensors, such as the angular speed sensor 18, acceleration sensor 19, touch sensor 22, floor touch confirming sensors 23R/L, orientation sensor 24, distance sensor 25, microphone 26, loudspeaker 27 and potentiometers $\mathbf{30}_1$ to $\mathbf{30}_n$, LEDs 28 and the actuators $\mathbf{29}_1$ to $\mathbf{29}_n$, are connected via associated hubs $\mathbf{31}_1$ to $\mathbf{31}_n$ to the signal processing circuit 14 of the controlling unit 16. The battery 17 and the picture processing circuit 21 are directly connected to the signal processing circuit 14.

The signal processing circuit 14 sequentially take in the sensor data, picture data or the audio data, supplied from the above sensors, to sequentially store the data over internal bus 15 in preset positions within the DRAM 11. On the other hand, the signal processing circuit 14 sequentially take in residual battery capacity data, indicating the residual battery capacity, supplied from the battery 17, to store the data in a preset positions in the DRAM 11.

The various sensor data, picture data, speech data and the residual battery capacity data, stored in the DRAM 11, are subsequently utilized when the CPU 10 exercises control on the operation of the robot apparatus 1.

At an initial operating stage when the power supply of the robot apparatus 1 is turned on, the CPU 10 actually reads out the control program stored on a memory card 32 loaded in a PC card slot, not shown, of the body trunk unit 2, or stored in the flash ROM 12, directly through the PC card interfacing circuit 13, to store the so read out program in the DRAM 11.

The CPU 10 checks its own status or the surrounding status, and whether or not a command or an behavior from a user was made, based on the sensor data, picture data, speech data and the residual battery capacity data, sequentially stored in the DRAM 11 from the signal processing circuit 14 as described above.

The CPU 10 decides on the next behavior, based on the verified results and on the control program stored in the DRAM 11, and actuates the necessary actuators $\mathbf{29}_1$ to $\mathbf{29}_n$, based on the so determined results, to cause the arm units 4R/L to be swung in the up-and-down direction or in the left-and-right direction or to actuate the leg units 5R/L to cause the walking behavior.

The CPU 10 generates speech data as necessary to send the so generated speech data through the signal processing circuit 14 to the loudspeaker 27 to output the speech corresponding to the speech signals to outside or to turn the LED 28 on or off for lighting or extinguishing the light.

In this manner, the robot apparatus 1 is able to take autonomous behaviors, responsive to the own state and to surrounding states, or commands and behaviors from the user.

Meanwhile, the robot apparatus 1 is able to take autonomous behaviors responsive to its inner state. Referring to FIGS. 7 to 12, an illustrative structure of the software of a control program in the robot apparatus 1 is now explained. Meanwhile, the control program is stored in the flash ROM 12 from the outset, as described above, and is read out in the initial operating stage following power up of the robot apparatus 1.

Figure 7:
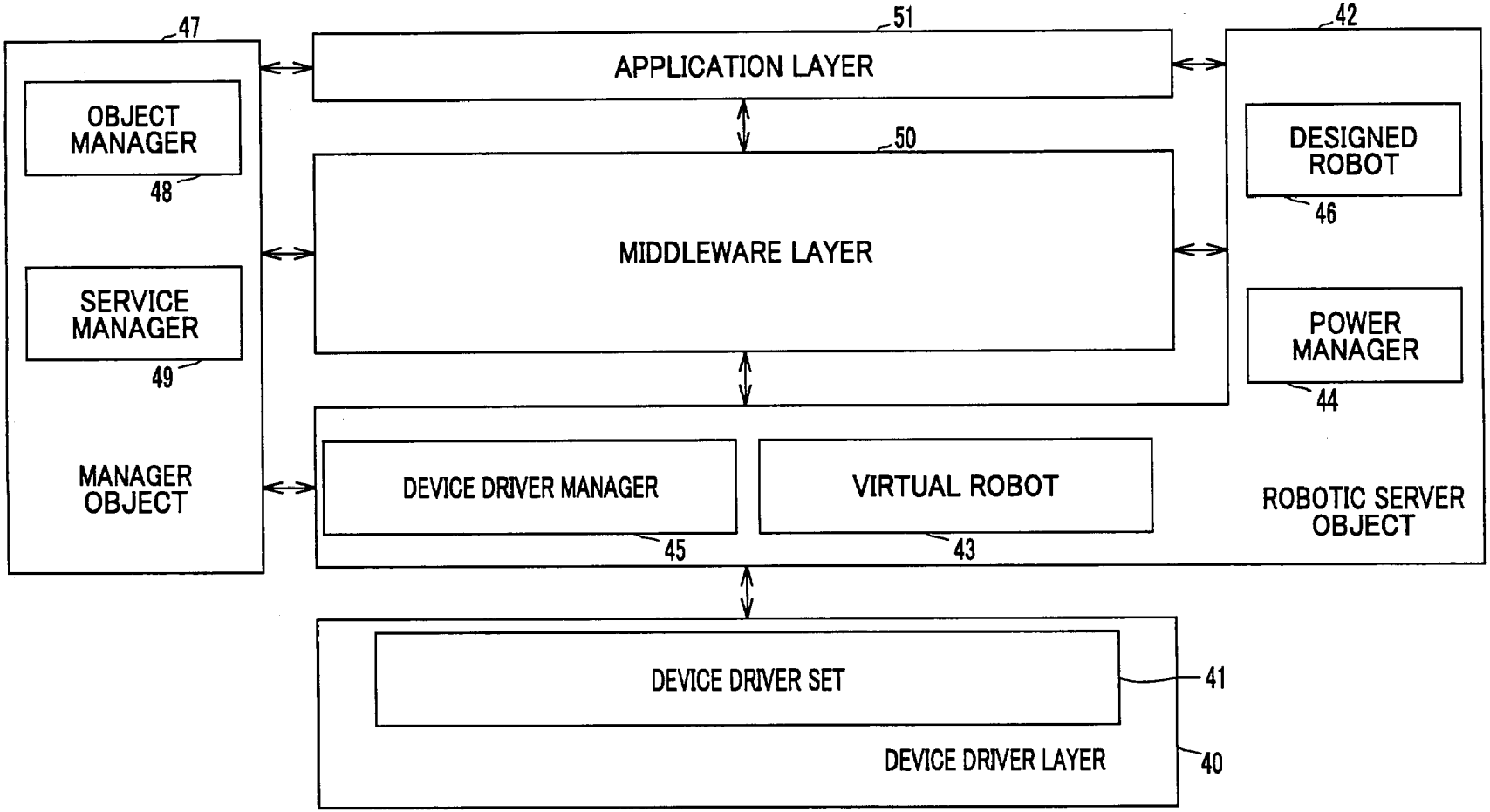
FIG. 7 is a block diagram showing a software structure of the robot apparatus.

Referring to FIG. 7, a device driver layer 40 is the lowermost layer of the control program, and is made up by a device driver set 41 comprised of plural device drivers. Each device driver is an object allowed to have direct access to the hardware used in an ordinary computer, such as a CCD camera or a timer, and which performs processing responsive to interrupt from the associated with hardware.

A robotic server object 42 is a lowermost layer of the device driver layer 40, and is made up by a virtual robot 43, composed of a set of softwares providing an interface for accessing the hardware, such as the aforementioned various sensors or actuators $\mathbf{28}_1$ to $\mathbf{28}_n$, a power manager 44, made up by a set of softwares supervising the power supply switching, a device driver manager 45, made up by a set of softwares for supervising the other various device drivers, and a designed robot 46, made up by a set of softwares supervising the mechanism of the robot apparatus 1.

A manager object 47 is made up by an object manager 48 and a service manager 49. The object manager 48 is a set of softwares supervising the booting or end of operation of the softwares included in the robotic server object 42, middleware layer 50 and an application layer 51, while the service manager 49 is a set of softwares supervising the interconnection among the respective objects based on the connection information among the respective objects stated in a connection file stored in the memory card.

The middleware layer 50 is an upper layer of the robotic server object 42 and is made up by a set of softwares providing the basic functions of the robot apparatus 1, such as picture or speech processing. The application layer 51, on the other hand, is an upper layer of the middleware layer 50 and is made up by a set of softwares determining the behavior of the robot apparatus 1 based on the results of processing by the respective softwares making up the middleware layer 50.

Figure 8:
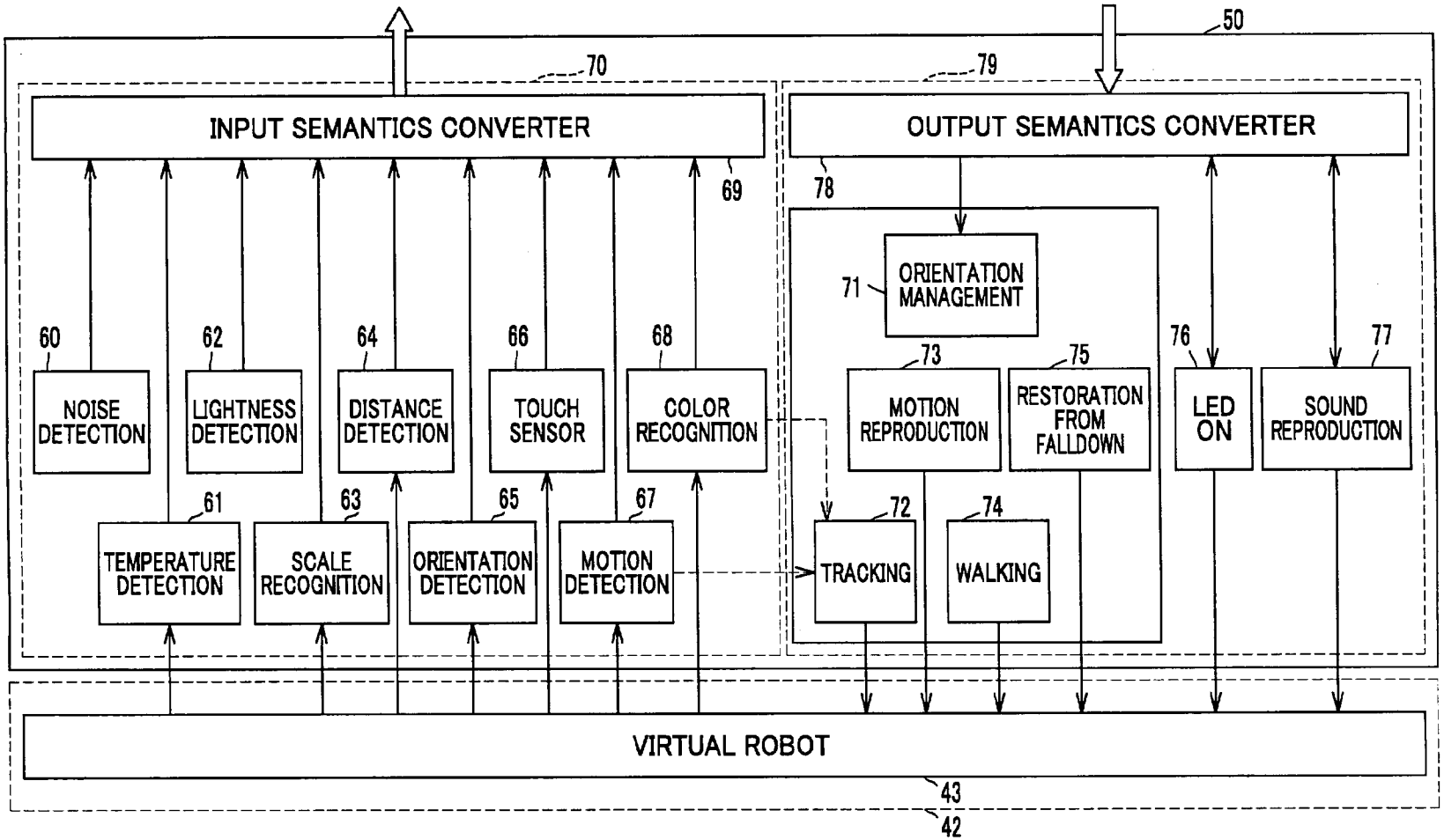
FIG. 8 is a block diagram showing the structure of a middleware layer in a software structure of the robot apparatus.

FIG. 8 shows a specified middleware structures of the middleware layer 50 and the application layer 51.

Referring to FIG. 8, the middleware layer 50 is made up by a recognition system 70 and an output system 79. The recognition system 70 includes signal processing modules 60 to 68 for detecting the noise, temperature, lightness, sound scales, distance and the orientation, as a touch sensor, and for detecting the motion and the color, and an input semantics converter module 69, while the output system 79 includes an output semantics converter module 78 and signal processing modules 71 to 77 for orientation management, for tracking, motion reproduction, walking, restoration from falldown, LED lighting and for sound reproduction.

The respective signal processing modules 60 to 68 of the recognition system 70 take in relevant ones of the sensor data, picture data and the speech data, read out from the DRAM by the virtual robot 43 of the robotic server object 42 and perform preset processing on the so taken-in data to send the processed result to the input semantics converter module 69. For example, the virtual robot 43 is designed as a component responsible for transmitting/receiving or converting signals, under a preset communication protocol.

Based on the processed results, applied from these signal processing modules 60 to 68, the input semantics converter module 69 recognizes its own state, surrounding state, command from the user or the behavior by the user, such as [noisy], [hot], [light], [a ball detected], [a falldown detected], [stroked], [patted], [the sound scales of do, mi and so on heard], [a moving object detected], or [an obstacle detected], and outputs the recognized results to the application layer 51.

Figure 9:
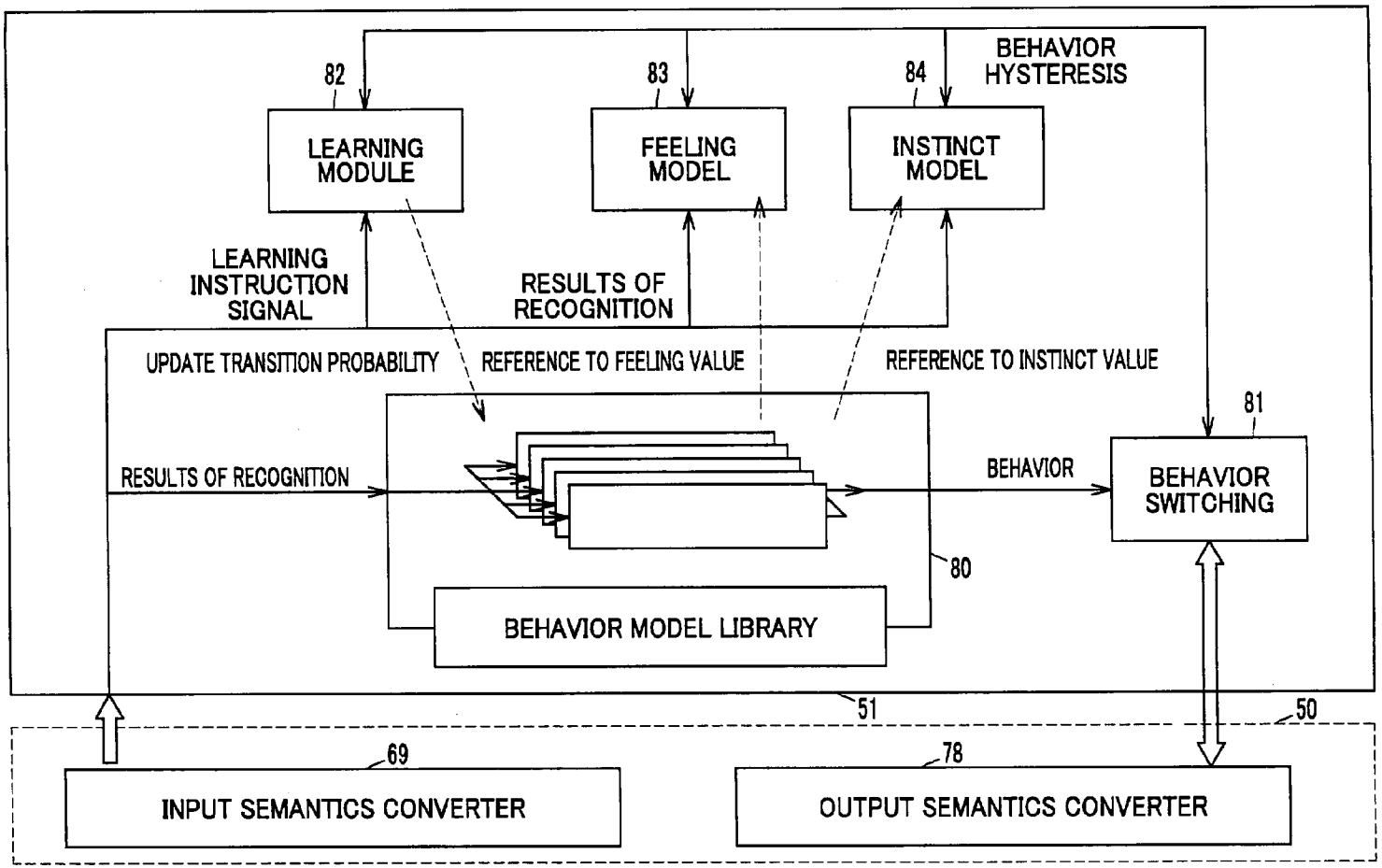
FIG. 9 is a block diagram showing the structure of an application layer in the software structure of the robot apparatus.

Referring to FIG. 9, the application layer 51 is made up by five modules, namely an behavior model library 80, an behavior switching module 81, a learning module 82, a feeling model 83 and an instinct model 84.

Figure 10:
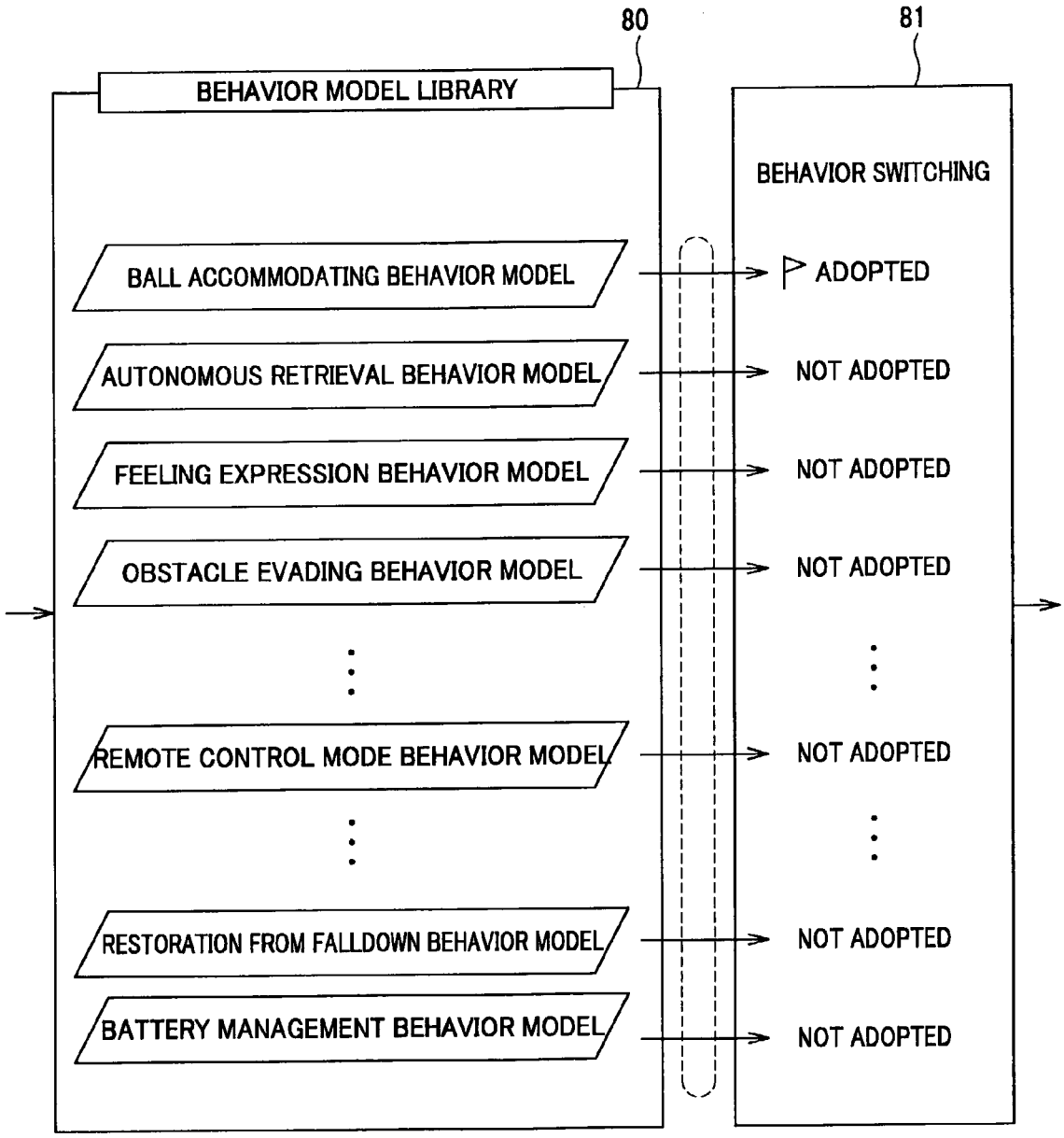
FIG. 10 is a block diagram showing the structure of an behavior model library of the application layer.
Figure 11:
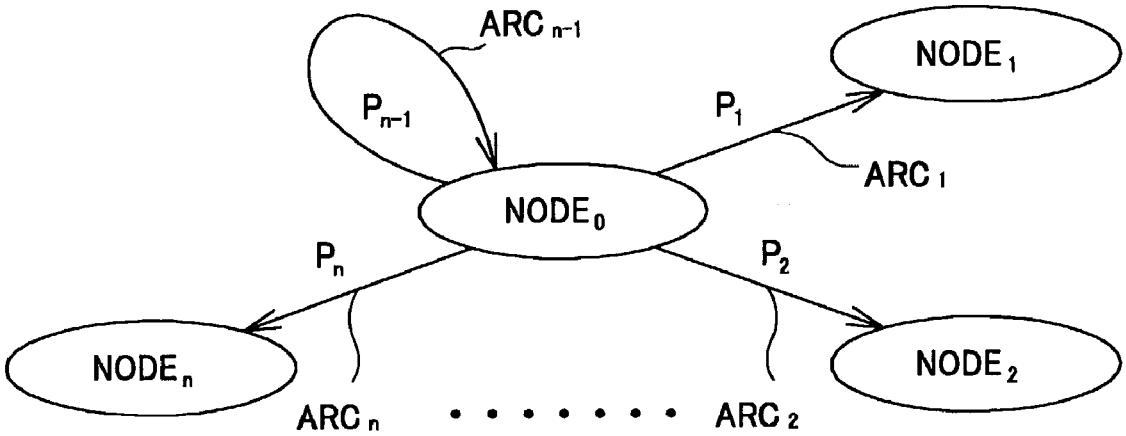
FIG. 11 illustrates a finite probability automaton which provides the information for determining the behavior of the robot apparatus.

In the behavior model library 80, there are provided independent behavior models in association with several pre-selected conditional items, such as [case where residual battery capacity is diminished], [restoration from the faldown state], [case where an obstacle is to be avoided], [case where a feeling is to be expressed], [case where a ball has been detected], as shown in FIG. 10.

When the results of the recognition are given from the input semantics converter module 69 or when a preset time has elapsed from the time the last result of recognition was given, the above behavior models decide on the next behaviors to be taken, as reference is had to parameter values of the associated emotions stored in the feeling model 83 or to parameter values of the associated desires held in the instinct model 84 to output the determined results to the behavior switching module 81, as subsequently described.

In the present embodiment, the respective behavior models use an algorithm, termed finite probability automaton, as a technique for determining the next behaviors. In this algorithm, the next one of the other nodes $NODE_0$ to $NODE_n$ shown in FIG. 11 to which transfer is to be made from one of the nodes $NODE_0$ to $NODE_n$ is probabilistically determined based on the transition probability values $P_1$ to $P_n$ as set for each of the arcs $ARC_1$ to $ARC_{n-1}$ interconnecting the respective nodes $NODE_0$ to $NODE_n$.

Specifically, the respective behavior models each include a status transition table 90, forming its own behavior model, for each of the nodes $NODE_0$ to $NODE_n$, each in association with the nodes $NODE_0$ to $NODE_n$, as shown in FIG. 12.

In this status transition table 90, input events (results of the recognition), representing the conditions of transition in the node of $NODE_0$ to $NODE_n$, are entered in the column of the [input event name] in the order of the falling priority, and further conditions for the transition conditions are entered in the relevant rows of columns of the [data name] and [data range].

Thus, in the node $NODE_{100}$, represented in the status transition table 90 of FIG. 12, given the results of the recognition of [ball detected], the ball [size] being in a range [from 0 to 1000] which is afforded along with the results of the recognition, represents the condition for transition to the other node. In similar manner, given the results of the recognition of [obstacle detected], the [distance] to the obstacle afforded along with the results of the recognition being in a range [from 0 to 100], represents the condition for transition to the other node.

Moreover, if, in this node $NODE_{100}$, there is no input of the results of recognition, but any of the values of the parameters [joy], [surprise] and [sadness], held by the feeling model 83, among the parameters of the emotions and desires, held by the feeling model 83 and the instinct model 84, periodically referenced by the behavior models, is in a range from [50 to 100], transition may be made to the other node.

In the status transition table 90, the names of the nodes, to which transition may be made from the node $NODE_0$ to $NODE_n$, are entered in the row [node of destination of transition] in the column [transition probability to the other node], while the transition probabilities to the other node of the nodes $NODE_0$ to $NODE_n$, to which transition may be made when all the conditions entered in the columns of the [input event name], [data name] and [data range] are met, are entered in the relevant cells of the column [transition probability to the other node]. Also entered in the row [output behavior] in the column [transition probability to the other node] are the behaviors to be output in making transition to the other nodes of the node $NODE_0$ to $NODE_n$. Meanwhile, the sum of the probabilities of the respective rows in the column [transition probability to the other node] is 100%.

Thus, in the node $NODE_{100}$, indicated in the status transition table 90 of FIG. 12, if the results of the recognition are such that the [ball is detected] and the [size] of the ball is in a range from [0 to 1000], transition may be made to the [node NODE120]] and the behavior [ACTION 1] is taken at this time.

Each behavior model is constructed that a number of the nodes $NODE_0$ to the node $NODE_n$, stated in the status transition table 90, are concatenated, such that, when the results of the recognition are afforded from the input semantics converter module 69, the next behavior is determined probabilistically by exploiting the status transition table of the corresponding nodes $NODE_0$ to $NODE_n$, with the results of the decision being output to the behavior switching module 81.

The behavior switching module 81, shown in FIG. 9, selects the output behavior from the behaviors output from the behavior models of the behavior model library 80 so that the behavior selected is one that is output from the predetermined behavior model of the highest rank in the priority order. The behavior switching module 81 sends a command for executing the behavior, referred to below as the behavior command, to an output semantics converter module 78 of the middleware layer 50. Meanwhile, in the present embodiment, the behavior models shown in FIG. 10 becomes higher in the descending direction in the drawing.

Based on the behavior completion information afforded from the output semantics converter module 78 after the end of the behavior, the behavior switching module 81 informs the learning module 82, feeling model 83 and the instinct model 84 of the end of the behavior.

The learning module 82 inputs the results of the recognition of the instructions, received as the action from the user, such as [patting] or [stroking], among the results of the recognition afforded from the input semantics converter module 69.

Based on the results of the recognition and on the notice from the behavior switching module 81, the learning module 82 changes the corresponding transition probability of the corresponding behavior model in the behavior model library 80 for lowering and raising the probability of occurrence of the behavior in case of patting (scolding) and stroking (praising), respectively.

On the other hand, the feeling model 83 holds parameters indicating the intensity of each of six emotions of [joy], [sadness], [anger], [surprise], [disgust] and [fear]. The feeling model 83 periodically updates the parameter values of these emotions based on the specified results of the recognition afforded by the input semantics converter module 69, such as [patting] or [stroking], time elapsed and on notices from the behavior switching module 81.

Specifically, the feeling model 83 calculates, based on the results of the recognition supplied from the input semantics converter module 69, the behavior of the robot apparatus 1 at this time and on the time elapsed since the previous update operation, a parameter value E[t+1] of a given emotion in the next period by the equation (1):

$$E(t+1)=E[t]+k_e\times\Delta E(t) \quad (1)$$

where ΔE(t) is the variation of the emotion as calculated by a preset equation for calculation, E[t] is the current parameter value of the emotion, and $k_e$ is the coefficient representing the sensitivity of the emotion, and substitutes the parameter value E[t+1] for the current parameter value of the emotion E[t] to update the parameter value of the emotion. The feeling model 83 also updates the parameter values of the totality of the emotions in similar manner.

Meanwhile, to which extent the results of the recognition or the notice from the output semantics converter module 78 affect the amount of the variation ΔE[t] of the parameter values of the respective emotions is predetermined, such that the results of the recognition [being patted] seriously affects the amount of the variation ΔE[t] of the parameter value of the emotion [anger], while the results of the recognition [being stroked] seriously affects the amount of the variation ΔE[t] of the parameter value of the emotion [joy].

It is noted that the notice from the output semantics converter module 78 is the what may be said to be the feedback information of the behavior (behavior end information), that is the information concerning the results of the occurrence of the behavior, and that the feeling model 83 changes its emotion by this information. For example, the behavior of [shouting] lowers the feeling level of anger. Meanwhile, the notice from the output semantics converter module 78 is also input to the learning module 82 such that the learning module 82 changes the corresponding transition probability of the behavior model based on such notice.

Meanwhile, the feedback of the results of the behavior may be made by the output of the behavior switching module 81 (behavior added by the feeling).

The instinct model 84 holds parameters, indicating the intensity of four independent desires, namely [desire for exercise], [desire for affection], [appetite] and [curiosity]. Based on the results of the recognition afforded by the input semantics converter module 69, time elapsed and on the notice from the behavior switching module 81, the instinct model 84 periodically updates the parameters of these desires.

Specifically, the instinct model 84 updates, for the [desire for exercise], [desire for affection] and [curiosity], based on the results of the recognition, time elapsed and on the notice from the output semantics converter module 78, the parameter value of the desire in question by calculating, at a preset period, a parameter value for the desire in question I[k+1] for the next period, using the following equation (2):

$$I[k+1]=I[k]+k_i\times\Delta I[k] \quad (2)$$

where ΔI[k] is the amount of the variation of the desire as calculated by a preset equation for calculation, I[k] is the current parameter value of the desire in question and $k_i$ is the coefficient expressing the sensitivity of the desire in question, and by substituting the results of the calculation for the current parameter value I[k] of the desire in question. In similar manner, the instinct model 84 updates the parameter values of the respective desires different than the [appetite].

Meanwhile, to which extent the results of the recognition and the notice from the output semantics converter module 78 affect the amount of the variation ΔI[k] of the parameter values of the respective desires is predetermined, such that the notice from the output semantics converter module 78 seriously affects the amount of the variation ΔI[k] of the [fatigue].

In the present embodiment, the parameter values of the respective emotions and desires (instincts) are controlled to be varied in a range from 0 to 100, while the values of the coefficients $k_e$ and $k_i$ are set from one emotion to another and from one desire to another.

On the other hand, the output semantics converter module 78 of the middleware layer 50 gives abstract behavioral commands afforded by the behavior switching module 81 of the application layer 51, such as [advance], [joy], [speak] or [tracking (track a ball)], to the signal processing modules 71 to 77 of the output system 79, as shown in FIG. 8.

If a behavioral command is issued, the signal processing modules 71 to 77 generates servo command values to be supplied to the associated actuator for performing the behavior, speech data of the sound output from the loudspeaker or the driving data to be supplied to the LED, to send these values or data to the associated actuator, loudspeaker or to the LED, through the virtual robot 43 of the robotic server object 42 and the relevant signal processing circuitry.

In this manner, the robot apparatus 1 is able to perform autonomous behavior, responsive to its own inner status, surrounding (external) status and commands or actions from the user, based on the aforementioned control program.

This control program is supplied through a recording medium recorded in a robot apparatus readable form. The recording medium for recording the control program may be exemplified by magnetically readable recording mediums, such as magnetic tapes, flexible discs or magnetic cards, and optically readable recording mediums, such as CD-ROMs, MOs, CD-R or DVD. The recording medium may also be exemplified by semiconductor memories, such as memory cards of rectangular, square-shaped or the like shape, or IC card. The control program may also be afforded over e.g., the Internet.

These control programs are reproduced via dedicated read-in drivers or personal computers, or transmitted over cable or wireless connection so as to be read-in by the robot apparatus 1. If equipped with a driving device for a small-sized recording medium, such as semiconductor memories or IC card, the robot apparatus 1 is also able to read-in the control program directly from the recording medium.

In the above-described robot apparatus 1, the aforementioned algorithm for speech synthesis is mounted as the sound reproducing module 77 in FIG. 8. This sound reproducing module 77 is responsive to a sound output command, such as [utter with joy] or [sing a song], determined by the upper level model, such as the behavioral model, to generate actual speech waveform data, which is then transmitted sequentially to a loudspeaker device of the virtual robot 43. In this manner, the robot apparatus 1 is able to utter a speech or a singing, expressive of the feeling, like a human being, through the loudspeaker 27, shown in FIG. 6, thus assuring improved entertaining characteristics and improving the friendly relationship with the human being.

The present invention has been disclosed only in the perspective of illustration and hence a large variety of modifications may be made without departing its scope.

For example, in the above-described embodiment, the singing data is specified by the signing tag in the text and is separated in a tag processing unit. The present invention is not limited to this embodiment such that simply the singing data of a preset format representing the singing may be input and the speech may then be synthesized based on the metrical data prepared from the singing data. This enables the singing to be synthesized by spontaneous speech closer to the human voice.

While the invention has been described in accordance with certain present embodiments thereof illustrated in the accompanying drawings and described in the above description in detail, it should be understood by those ordinarily skilled in the art that the invention is not limited to the embodiments, but various modifications, alternative constructions or equivalents can be implemented without departing from the scope and the spirit of the present invention as set forth and defined in the appended claims.

What is claimed is:

1. A speech synthesis method comprising:

a separating step of separating, from an input text, a singing data portion specified by a singing tag and a text portion;

a singing metrical data forming step of forming singing metrical data from said singing data, said singing metrical data expresses parameters of a lyric;

a speech symbol sequence forming step of forming a speech symbol sequence for said text portion;

a metrical data forming step of forming metrical data from said speech symbol sequence, said metrical data expresses parameters of a speech signal sequence;

a natural metrical data selecting step of analyzing said text portion and selecting, if preset words or sentences exist in said text portion, natural metrical data associated with said preset words or sentences, extracted in advance from the uttered speech of a human being, from a storage means; and a speech synthesis step of synthesizing the speech based on said singing metrical data, said natural metrical data or said metrical data;

wherein said speech symbol sequence is formed for the section of the text portion other than said preset words or sentences, wherein the natural metrical data includes data about a pitch period, a pitch duration, and a pitch volume registered in a natural metrical dictionary stored in the storage means.

2. The speech synthesis method according to claim 1 wherein at least the pitch and the duration of each sound note, the lyric accorded to each sound note, rest, tempo and loudness of said singing data are specified by tags.

3. The speech synthesis method according to claim 1 wherein, in said singing metrical data forming step, the vibrato is applied by changing the pitch period and the duration of each phoneme in said singing metrical data.

4. The speech synthesis method according to claim 3 wherein, in said singing metrical data forming step, the vibrato is applied to a phoneme longer than a preset duration.

5. The speech synthesis method according to claim 3 wherein, in said singing metrical data forming step, the vibrato is applied to the phonemes of the portion of the singing data specified by a tag.

6. The speech synthesis method according to claim 1 further comprising:

a parameter adjusting step of adjusting the pitch of respective phonemes in said singing metrical data.

7. A speech synthesis apparatus comprising:

separating means for separating, from an input text, a singing data portion specified by a singing tag and a text portion;

singing metrical data forming means for forming singing metrical data from said singing data, said singing metrical data expresses parameters of a lyric;

speech symbol sequence forming means for forming a speech symbol sequence for said text portion;

metrical data forming means for forming metrical data from said speech symbol sequence, said metrical data expresses parameters of a speech signal sequence;

storage means having pre-stored therein preset words or sentences and natural metrical data corresponding to said preset words or sentences extracted from the utterance of a human being;

natural metrical data selecting means for analyzing said text portion and selecting, if preset words or sentences exist in said text portion, natural metrical data associated with said preset words or sentences, extracted in advance from the uttered speech of the human being, from said storage means; and speech synthesis means for synthesizing the speech based on said singing metrical data, said natural metrical data or said metrical data;

wherein said speech symbol sequence is formed for the section of the text portion other than said preset words or sentences, wherein the natural metrical data includes data about a pitch period, a pitch duration, and a pitch volume registered in a natural metrical dictionary stored in the storage means.

8. The speech synthesis apparatus according to claim 7 wherein at least the pitch and the duration of each sound note, the lyric accorded to each sound note, rest, tempo and loudness of said singing data are specified by tags.

9. The speech synthesis apparatus according to claim 7 wherein, in said singing metrical data forming means, the vibrato is applied by changing the pitch period and the duration of each phoneme in said singing metrical data.

10. The speech synthesis apparatus according to claim 9 wherein, in said singing metrical data forming means, the vibrato is applied to the phoneme longer than a preset duration.

11. The speech synthesis apparatus according to claim 10 wherein, in said singing metrical data forming means, the vibrato is applied to a phoneme of the portion of the singing data specified by a tag.

12. The speech synthesis apparatus according to claim 7 further comprising:

parameter adjusting means for adjusting the pitch of the respective phonemes in said singing metrical data.

13. A computer-readable recording medium having recorded thereon a program for having a computer execute preset processing, said program comprising:

a separating step of separating, âom an input text, a singing data portion specified by a singing tag and a text portion;

a singing metrical data forming step of forming singing metrical data from said singing data, said singing metrical data expresses parameters of a lyric;

a speech symbol sequence forming step of forming a speech symbol sequence for said text portion;

a metrical data forming step of forming metrical data from said speech symbol sequence, said metrical data expresses parameters of a speech signal sequence;

a natural metrical data selecting step of analyzing said text portion and selecting, if preset words or sentences exist in said text portion, natural metrical data associated with said preset words or sentences, extracted in advance from the uttered speech of a human being, from storage means; and a speech synthesis step of synthesizing the speech based on said singing metrical data, said natural metrical data or said metrical data;

wherein said speech symbol sequence is formed for the section of the text portion other than said preset words or sentences, wherein the natural metrical data includes data about a pitch period, a pitch duration, and a pitch volume registered in a natural metrical dictionary stored in the storage means.

14. The recording medium according to claim 13 wherein at least the pitch and the duration of each sound note, the lyric accorded to each sound note, rest, tempo and loudness of said singing data are specified by tags.

15. The recording medium according to claim 13 wherein, in said singing metrical data forming step, the vibrato is applied by changing the pitch period and the duration of each phoneme in said singing metrical data.

16. The recording medium according to claim 15 wherein, in said singing metrical data forming step, the vibrato is applied to a phoneme longer than a preset duration.

17. The recording medium according to claim 15 wherein, in said singing metrical data forming step, the vibrato is applied to a phoneme of the portion of the singing data specified by a tag.

18. The recording medium according to claim 13 wherein said program further comprising:

a parameter adjusting step of adjusting the pitch of the respective phonemes in said singing metrical data.

19. An autonomous robot apparatus for performing a behavior based on the input information supplied thereto, comprising:

separating means for separating, from an input text, a singing data portion specified by a singing tag, and a text portion;

singing metrical data forming means for forming singing metrical data from said singing data, said singing metrical data expresses parameters of a lyric;

speech symbol sequence forming means for forming a speech symbol sequence for said text portion;

metrical data forming means for forming metrical data from said speech symbol sequence, said metrical data expresses parameters of a speech signal sequence;

storage means for storing preset words or sentences and natural metrical data corresponding to said preset words or sentences extracted in advance from the utterance of a human being;

natural metrical data selecting means for analyzing said text portion and selecting, if preset words or sentences exist in said text portion, natural metrical data associated with said preset words or sentences extracted in advance from the uttered speech of the human being, from storage means; and speech synthesis means for synthesizing the speech based on said singing metrical data, said natural metrical data or said metrical data;

wherein said speech symbol sequence is formed for the section of the text portion other than said preset words or sentences, wherein the natural metrical data includes data about a pitch period, a pitch duration, and a pitch volume registered in a natural metrical dictionary stored in the storage means.

20. The robot apparatus according to claim 19 wherein at least the pitch and the duration of each sound note, the lyric accorded to each sound note, rest, tempo and loudness of said singing data are specified by tags.

21. The robot apparatus according to claim 19 wherein, in said singing metrical data forming means, the vibrato is applied by changing the pitch period and the duration of each phoneme in said singing metrical data.

22. The robot apparatus according to claim 21 wherein, in said singing metrical data forming means, the vibrato is applied to a phoneme longer than a preset duration.

23. The robot apparatus according to claim 22 wherein, in said singing metrical data forming means, the vibrato is applied to a phoneme of the portion of the singing data specified by a tag.

24. The robot apparatus according to claim 19 further comprising:

a parameter adjusting means of adjusting the pitch of the respective phonemes in said singing metrical data.

* * * * *